US006942410B1

(12) United States Patent
Drewnoski

(10) Patent No.: US 6,942,410 B1
(45) Date of Patent: Sep. 13, 2005

(54) MECHANICAL PENCIL

(76) Inventor: Christopher Drewnoski, 7901 Emerald Dr., Emerald Isle, NC (US) 28594

( * ) Notice: Subject to any disclaimer, the term of this patent is extended or adjusted under 35 U.S.C. 154(b) by 0 days.

(21) Appl. No.: 10/710,150

(22) Filed: Jun. 22, 2004

(51) Int. Cl.[7] ..... B43K 29/06
(52) U.S. Cl. ..... 401/50; 401/88
(58) Field of Search ..... 401/50, 52, 88, 401/92–94; 33/42, 43; 30/451–462

(56) References Cited

U.S. PATENT DOCUMENTS 193,545 A * 7/1877 Park ..... 30/458
336,250 A * 2/1886 Meigs ..... 401/93
502,632 A * 8/1893 Norell ..... 30/457
831,480 A * 9/1906 Searle ..... 401/92
1,125,060 A * 1/1915 Cera ..... 269/1
2,378,973 A * 6/1945 Borsodi ..... 401/93

* cited by examiner

*Primary Examiner*—David J. Walczak
(74) *Attorney, Agent, or Firm*—John F Bohland

(57) ABSTRACT

A mechanical carpenter's pencil having an integral sharpening guide providing a reference surface to which the lead may be trimmed for sharpening. The pencil user may use a knife to trim the lead flush with the sharpening guide surface or may abrade the lead on a convenient surface until the lead is flush with the sharpening guide surface. After trimming, the lead is advanced to expose the freshly sharpened point and is ready for precision marking.

6 Claims, 4 Drawing Sheets

(a)

(b)

MECHANICAL PENCIL

BACKGROUND OF INVENTION

The present invention is related to mechanical pencils. More particularly, it is related to mechanical carpenters' pencils with means for sharpening the working end of the pencil lead.

The vast majority of pencils are substantially round in cross section. They are available as cylindrical graphite leads encased in wooden bodies and as mechanical pencils with loose graphite leads gripped mechanically in reusable bodies. Wooden pencils are sharpened by trimming the wooden body and the lead in order to form a sharp point on the lead, thereby enabling the user to mark with precision and accuracy. Most mechanical pencils utilize small diameter leads that may be advanced as necessary and used without trimming or pointing.

Carpenters' pencils generally have substantially rectangular cross sections, a shape which has proven to be more durable than a circular cross section when marking a material having a rough surface, such as lumber. However, the noncircular cross section complicates the chore of sharpening, which is necessary for accuracy. Carpenters usually use a pocket knife or a utility knife to sharpen wood-cased pencils. A usable point can be produced in this manner, but the time required to produce a precision point is excessive.

U.S. Pat. No. 5,044,805, incorporated herein by reference, discloses a mechanical carpenter's pencil wherein a flat lead is gripped in a plastic body. No means are provided for sharpening the lead. General purpose mechanical pencils designed for writing on relatively smooth materials such as paper use thin leads having circular cross sections. Thin leads do not need to be sharpened; they can simply be advanced to provide a fresh point as the lead is consumed. On the other hand, the flat lead in a carpenter' s pencil must be sufficiently thick to provide mechanical strength for the more demanding application. Advancing the thick lead without sharpening results in a blunt end, not suitable for precision marking.

SUMMARY OF INVENTION

It is an object of the present invention to provide a mechanical pencil that accommodates flat leads and provides a pencil body surface that serves as a guide to facilitate lead sharpening, thereby enabling precision, fine-line marking.

A mechanical pencil according to the present invention has a flat surface at the working end of the pencil that serves a sharpening guide. The flat surface fully encompasses the lead path and provides a reference plane to which the lead may be trimmed by cutting or abrading.

DETAILED DESCRIPTION

Figure 1:
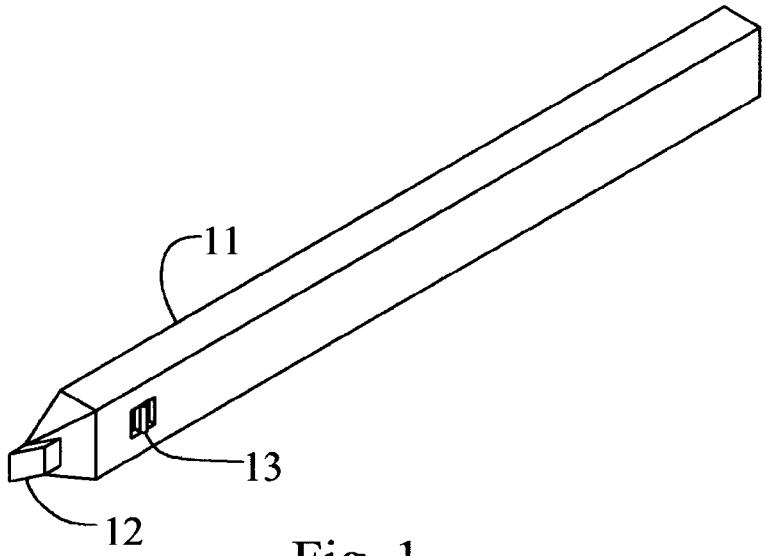
FIG. 1 is an isometric view of a preferred embodiment of a mechanical carpenter's pencil according to the present invention with a sharpened lead in position for marking.

A preferred embodiment of a mechanical carpenter's pencil according to the present invention is shown in FIG. 1. The pencil body (11) is made of plastic, wood, metal, or other suitable material. A rectangular cross section is illustrated in the figures, but the shapes of the exterior surfaces of the pencil body are not critical to its functionality except for the sharpening guide, which will be described later in this specification.

The pencil lead has a substantially rectangular cross section and slides in a matching cavity in the pencil body. The lead is advanced along the lead path to provide fresh material as the lead is consumed. A sharp pencil lead (12) is shown in FIG. 1 in position to be used for marking.

A manually operated wedge (13) is used to lock the lead in position for marking or sharpening. Other lead gripping means, such as those disclosed in U.S. Pat. No. 5,044,805, incorporated herein by reference, may also be used.

Figure 2:
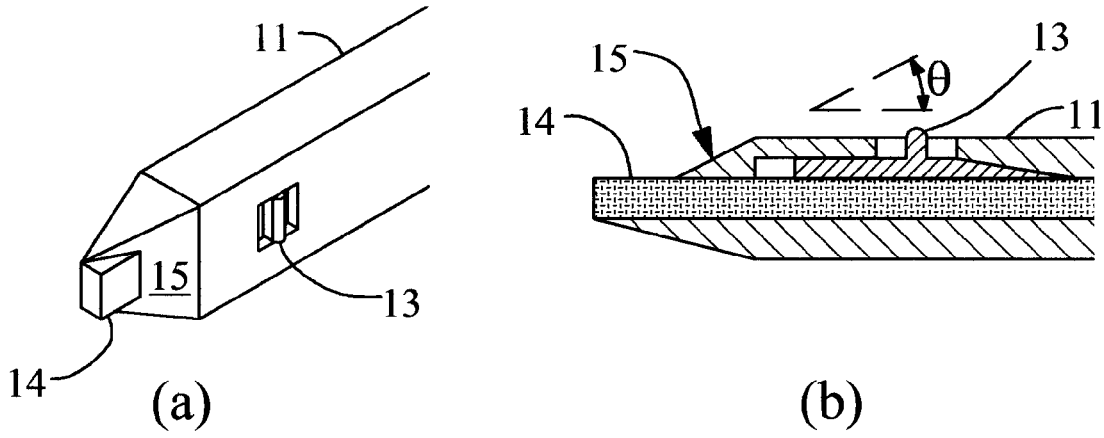
FIG. 2 shows an isometric view (a) and a cross section (b) of a mechanical carpenter's pencil according to the present invention with an unsharpened lead in position to be sharpened.
Figure 3:
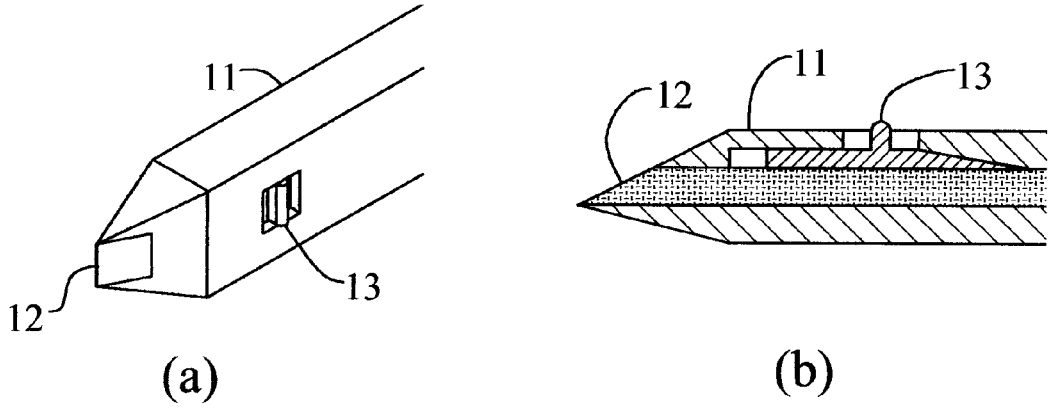
FIG. 3 shows an isometric view (a) and a cross section (b) of a mechanical carpenter's pencil according to the present invention with a sharpened lead in the sharpening position.
Figure 4:
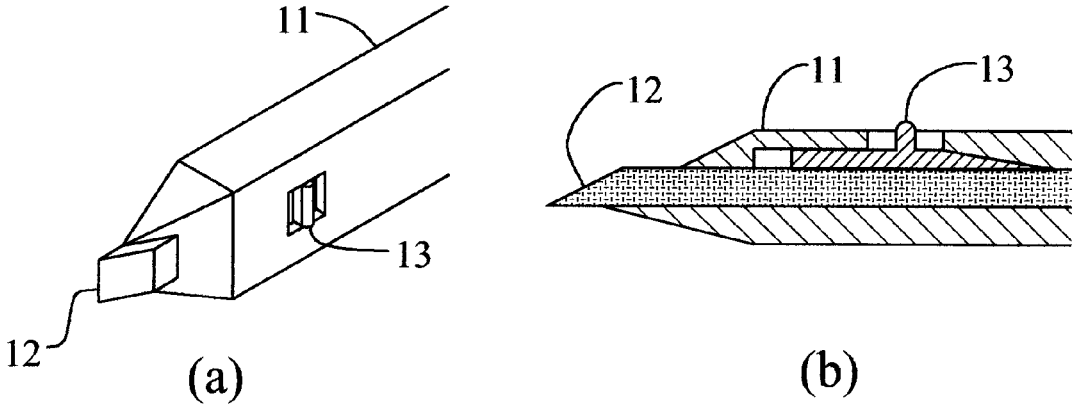
FIG. 4 shows an isometric view (a) and a cross section (b) of a mechanical carpenter's pencil according to the present invention with a sharpened lead in the marking position.

In FIG. 2 an unsharpened lead (14) is shown locked in the sharpening position. Lead sharpening is accomplished by removing the portion of the lead that extends beyond the sharpening guide surface (15) forming a sharpened lead (12), as shown in FIG. 3 and in FIG. 1. In FIG. 4 the sharpened lead (12) has been moved to the marking position.

The sharpening guide surface (15) is at angle $\theta$ relative to the long axis of the pencil, as shown in FIG. 2(*b*). Preferably, angle $\theta$ is between ten and sixty degrees. More preferably, angle $\theta$ is between thirty and fifty degrees. The sharpening guide surface is a substantially flat surface completely encompassing the lead path, thereby providing a reference surface to which the lead can be trimmed flush.

Figure 5:
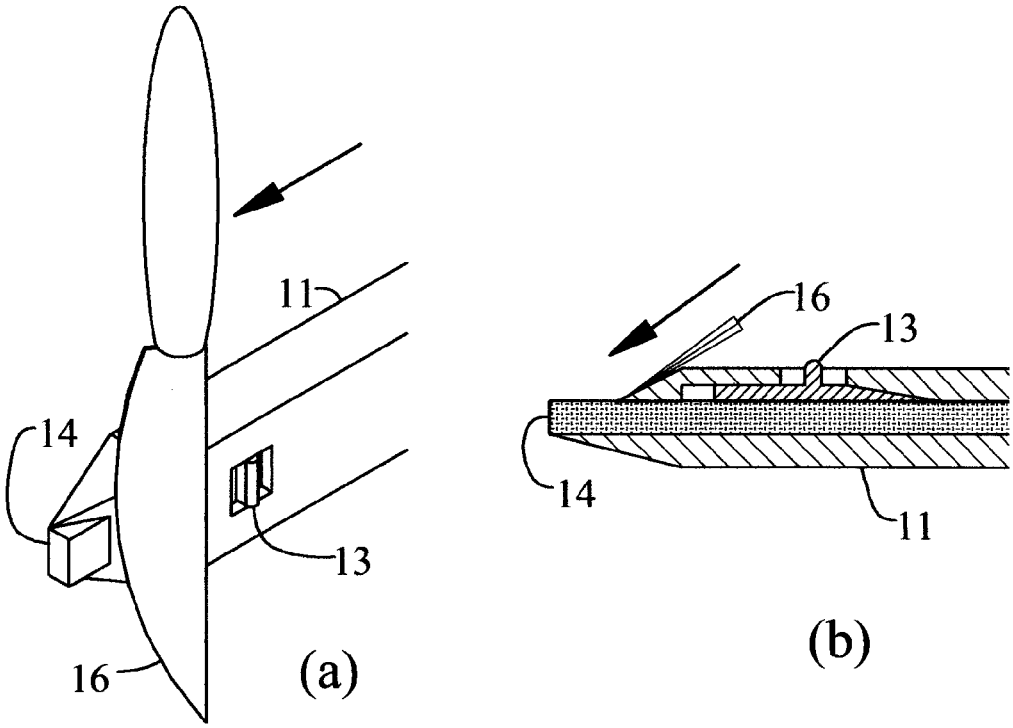
FIG. 5 shows an isometric view (a) and a cross section (b) of a pencil according to the present invention in position to be sharpened using a knife as the sharpening tool.

In a preferred method for sharpening a lead, the lead is locked in the position shown in FIG. 5 and a knife blade (16) is drawn at a low angle across the sharpening guide surface repeatedly until the lead is trimmed flush with the plane of the sharpening guide surface. The angle of the knife blade and the direction of its motion over the sharpening guide are shown FIG. 5. FIG. 5(*b*) shows a cross-section of the knife blade moving over the sharpening guide surface.

Figure 6:
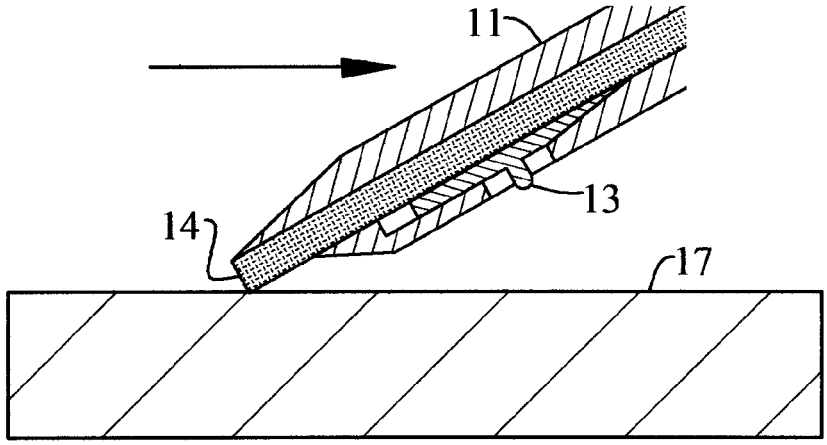
FIG. 6 shows a cross section of a pencil according to the present invention in position to be sharpened by abrasion.

A second preferred method for sharpening the lead in a carpenter's pencil according to the present invention is shown in FIG. 6. The pencil is inclined at an angle relative to a flat surface (17) so that the surface of the sharpening guide is parallel to the flat surface. The pencil is then drawn across the flat surface as shown by the arrow in FIG. 6, and the motion is repeated until the lead is worn so that it is substantially flush with the sharpening guide surface as shown in FIG. 3. The sharpened lead is then moved to the marking position as shown in FIG. 4.

Figure 7:
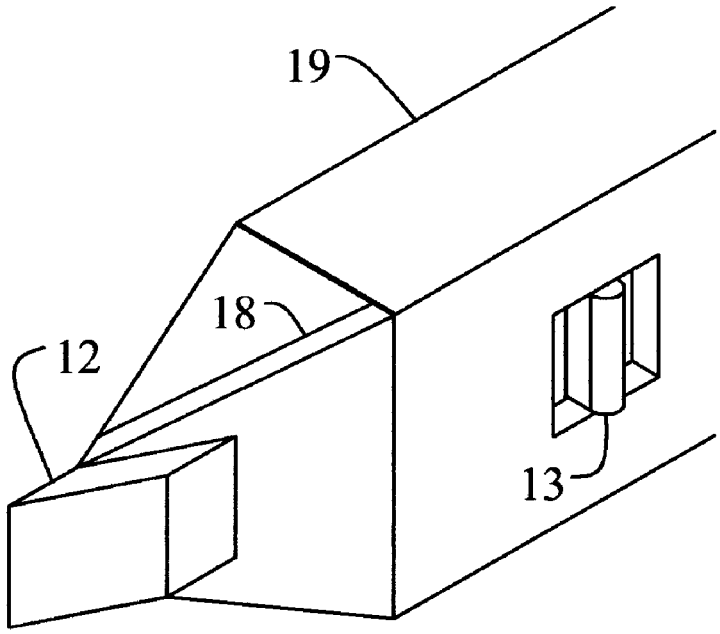
FIG. 7 shows a second preferred embodiment of a mechanical carpenter's pencil according to the present invention.
Figure 7:
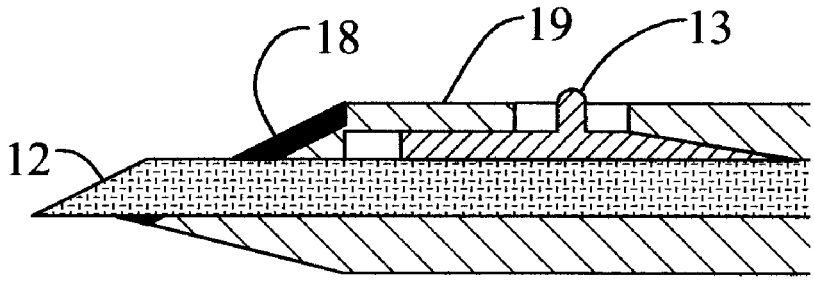

In a second preferred embodiment, shown in FIG. 7, a composite pencil body is formed by bonding a sharpening guide element (18) to a body (19) designed to accept the sharpening guide element. The shapes of the body and the sharpening guide element may vary to accommodate different manufacturing processes provided that they have suitable surfaces for bonding to each other and that the sharpening guide element has a flat surface fully encompassing the lead path, thereby providing a reference surface to which the lead may be trimmed. The sharpening guide element may be made of metal, glass, ceramic, or other materials resistant to cutting and abrasion, while the body may be made of wood, plastic or other materials having other desirable properties such as lightness or visual appeal.

What is claimed is:

1. A mechanical carpenter's pencil comprising:

a pencil body having a coaxial cavity forming a lead path, a working end, and a long axis, a pencil lead within said coaxial cavity, wherein said pencil lead has a substantially rectangular cross section, lead gripping means whereby the position of said pencil lead relative to said pencil body may be releasably locked, a planar sharpening guide surface encompassing said coaxial cavity at said working end of said pencil body.

2. The mechanical carpenter's pencil of claim 1 wherein the angle between said planar sharpening surface and said long axis of said pencil body is between ten and sixty degrees.

3. The mechanical carpenter's pencil of claim 2 wherein the angle between said planar sharpening surface and said long axis of said pencil body is between thirty and fifty degrees.

4. The mechanical carpenter's pencil of claim 1 wherein said pencil body is fabricated from metal.

5. The mechanical carpenter's pencil of claim 1 wherein said lead locking means is a manually operated wedge.

6. A mechanical carpenter's pencil comprising:

a pencil body having a coaxial cavity forming a lead path, a working end, and a long axis, a sharpening guide element bonded to said working end of said pencil body, a pencil lead within said coaxial cavity, wherein said pencil lead has a substantially rectangular cross section, lead gripping means whereby the position of said pencil lead relative to said pencil body may be releasably locked, a planar sharpening guide surface on said sharpening guide element encompassing said coaxial cavity at said working end of said pencil body.

* * * * *